US005308663A

United States Patent [19]

Nakagawa et al.

[11] Patent Number: 5,308,663

[45] Date of Patent: May 3, 1994

[54] BIODEGRADABLE NONWOVEN FABRIC AND ITS MOLDING VESSEL

[75] Inventors: Mutuo Nakagawa; Yasuo Nakagawa, both of Takarazuka; Masaaki Nishida, Amagasaki; Jun Hosokawa, Takamatsu; Masashi Nishiyama, Kan-onji; Takamasa Kubo; Kazutoshi Yoshihara, both of Takamatsu, all of Japan

[73] Assignees: Kanai Juyo Kogyo Company Limited, Hyogo; Director, General of Agency of Industrial Science and Technology, Tokyo, both of Japan

[21] Appl. No.: 782,778

[22] Filed: Oct. 23, 1991

Related U.S. Application Data

[63] Continuation-in-part of Ser. No. 537,628, Jun. 13, 1990.

[30] Foreign Application Priority Data

Jun. 20, 1989 [JP] Japan ..... 1-157046

[51] Int. Cl.[5] ..... B27N 1/02; D21F 11/00; B01D 24/00; B32B 3/26

[52] U.S. Cl. ..... 428/34.2; 162/157.7; 162/174; 162/177; 210/500.1; 210/507; 428/283; 428/288; 428/297; 428/303; 428/311.7; 428/311.9; 428/533; 428/536; 428/913

[58] Field of Search ..... 428/224, 289, 326, 403, 428/234, 235, 292, 34.2, 283, 288, 297, 303, 311.7, 311.9, 533, 536, 913; 424/447, 443; 521/312; 162/168, 157.7, 177, 174; 210/507, 500.1

[56] References Cited

U.S. PATENT DOCUMENTS

| | | | |
|---|---|---|---|
| 3,903,268 | 9/1975 | Balassa | 424/447 |
| 4,056,432 | 11/1977 | Slagel et al. | 527/312 |
| 4,755,421 | 7/1988 | Manning et al. | 428/292 |
| 4,931,551 | 6/1990 | Albisetti et al. | 424/443 |

FOREIGN PATENT DOCUMENTS

| | | |
|---|---|---|
| 0285258 | 12/1986 | Japan . |
| 0062302 | 3/1989 | Japan . |
| 2216555 | 3/1988 | United Kingdom . |

OTHER PUBLICATIONS

English translation of Morita et al, pp. 1–26.
English translations of Chiba et al, pp. 1–8.

*Primary Examiner*—James D. Withers
*Attorney, Agent, or Firm*—Wenderoth, Lind & Ponack

[57] ABSTRACT

A biodegradable nonwoven fabric and molded vessel suitable to throwaway use such as in domestic, wrapping, agricultural, gardening, and civil engineering field. A web of cellulose-based fibers are combined with chitosan salt and an interfiber binder comprising a combination of chitosan salt and fine cellulose, or by combined use of the interfiber binder and physical combining techniques. They are naturally decomposed by microorganisms in the soil and can dissolve the polution problems.

11 Claims, 5 Drawing Sheets

BIODEGRADABLE NONWOVEN FABRIC AND ITS MOLDING VESSEL

This application is a continuation-in-part of now abandoned application Ser. No. 07/537,628 filed on Jun. 13, 1990.

BACKGROUND OF THE INVENTION

1. Field of the Invention

This invention relates to nonwoven fabric suitable to throwaway use and particularly to a biodegradable nonwoven fabric which becomes extinct in the soil by microorganisms and to the molding vessel thereof.

2. Description of the Prior Art

Throwaway nonwoven fabrics typified by diapers are used in large quantities recently, because of their convenience. After use, however, they are treated as general wastes, and are disposed of by burning in an incineration site, because they are not decomposed in the soil and cause contamination of soil if used in reclamation. The increasing amount of use of the throwaway nonwoven fabrics is causing, therefore, a social problem such as damaged incineration furnaces and toxic exhaust gas, like other throwaway plastics.

In the field of agriculture and gardening, on the other hand, various materials are used for seedling mats and pots and planting mats. Rock wool, a mineral fiber, is used in large quantities because of its low price, hydrophilic nature, and adequate porosity. However it can be used only in the form of sheet, lacking moldability, and cannot be decomposed by microorganisms in the soil.

Pulp regenerated from old paper is cheap and excellent in hydrophilicity and water retentivity and is processed in the form of sheet and pot, but the decomposition of pulp is inhibited by the lignin contained in the pulp. In addition, lignin and a toughening agent such as acrylic amide naturally contained in the old paper are accumulated in the soil causing soil contamination. To solve these defects, cellulose based fabrics containing a smaller amount of lignin such as cotton and rayon, needle punched nonwoven fabrics, water needle punched nonwoven fabrics, etc, are used in the agricultural, gardening, and civil engineering fields. These fiber aggregates are completely decomposed by the microorganisms in the soil in periods of 1-3 days and produces no soil contamination, but can only be used generally in the form of sheet limited in use. In a special case, it is sewed into bag form, but is expensive. Also, it is impossible to disintegrate these materials by natural decomposition and finally must depend on incineration.

SUMMARY OF THE INVENTION

It is an object of the invention to provide a biodegradable nonwoven fabric having a sufficient strength, water resistance, moldability, and properties to be decomposed by microorganisms in soil, useful in throwaway use in home, for wrapping, agriculture, gardening, and civil engineering fields, and a molding vessel thereof.

According to the invention, a fiber web comprising a cellulose structure such as cotton, rayon, and acetate is treated with a fine cellulose-chitosan composite as the inter-fiber binder or the fiber entangled with physical bonding means such as needle punching and water punching which fine cellulose-chitosan composite partially applied to the surface of the fiber forms a nonowoven fabric or its molding vessel completely decomposable by the microorganisms existing in soil to solve the environmental problems.

The fiber used in the invention is any of natural fibers or regenerated fibers or acetate fibers such as cotton, flax, pineapple veining, cuprammonium rayon, viscose rayon, and cellulose acetate. A mixture of these such as cotton or flax as the natural fiber combined with a regenerated fiber selected from the group consisting of viscose rayon, cuprammonium rayon, modified cross-sectional rayon and porous rayon, can also attain the object, but use of porous ravon fiber having large surface area and fibrilated fiber can preferably increase the decomposition rate of fiber in soil.

The above fibers are formed into parallel web, cross web, and random web by use of a known web former, and a fiber web formed by the physical entangling means, such as needle punching by using one of these webs or water punching.

To these fibers in the web or entangled web there is applied an aqueous mixed solution of chitosan salt and fine cellulose powder (aqueous chitosan solution with chitosan dissolved to 0.1-2.0% concentration preferably (0.2-1.0%), in a 0.5-1.0% aqueous solution of organic acid such as lactic acid, acetic acid, and citric acid with fine cellulose mixed therein) as the inter-fiber binder. This is applied by dipping method or a spray method adjusted to 0.5-10 parts (solid content) fine cellulose containing chitosan based on 100 parts (solid content) fiber and dried to form a nonwoven fabric.

A chitosan of 40-100% in deacetylation degree and 2,000-500,000 in molecular weight is used.

The compound ratio of chitosan and fine cellulose in the above binder between fibers is preferably 2:8 to 4:5 for film strength, and the film strength can be adjusted depending upon the fiber length of the fine cellulose. As the fine cellulose, those of 20-1000 μm in length and less than 1 μm in thickness of beated pulp is used. Here, the combination of cellulose and chitosan is described.

FIG. 2 is a structural view showing an example before reaction of fine cellulose 1*a* and/or cellulose-based fiber 1*b* and chitosan salt 4.

It is known that an aqueous chitosan salt solution is solidified upon heating and this solidification product swells and finally dissolves in water unless fixed by alkali. However, if heated together with cellulose and fine cellulose, it reacts with both celluloses and is not dissolved in water.

In this invention, to increase the form retension power and water-resisting strength in the wet condition, an inter-fiber connection was produced by the reaction of the amino groups possessed by the chitosan salt 4 with the hydroxyl groups, carbonyl groups, etc. existing on the surface of the fine cellulose 1*a* and cellulose-based fiber 1*b* by heating, instead of alkali-fixing treatment, as shown in FIG. 3. Further it is possible to use porous rayon fiber to increase the water resistant strength, and also by mixing fine cellulose fiber formed of beaten pulp having a diameter of less than 1 μm into an aqueous chitosan salt solution.

A nonwoven fabric using chitosan as an inter-fiber binder has a remarkably rigid feel, but the feel can be softened by using a plasticizer such as glycerin or starch in a mixing ratio to the degree which does not impair the water resistance strength.

It is also possible by impregnating the above biodegradable nonwoven fabric with a higher fatty acid such as stearic acid and palmitic acid to give a water repellency to the fabric and control the decomposing period in the soil. The decomposing period can be controlled by adjusting the chitosan and temperature, and the quantity of the carbonyl groups in the cellulose.

As another embodiment of the invention, it is possible to heighten the strength and form retention by needle punching a cellulose-based web in advance after formation. Further, it is also possible to form a biodegradable nonwoven fabric by fixing the fibers in a web with fibers entangled with each other by a known water needle machine, using as a binding means, an injection fluid of water, salt and an aqueous aqueous fine cellulose-chitosan salt solution comprising chitosan dissolved in an aqueous 0.2–1.0% solution of organic acid such as lactic acid, acetic acid, citric acid, and propyonic acid, into a chitosan concentration of 0.2–1.0%, and mixed with fine cellulose, and bonding 0.5–5 parts of chitosan by dehydration or squeezing roller to bond the entangled fibers to each other.

The biodegradable nonwoven fabric thus formed can be used as an antigrass, a heat insulating material, a seed-plot, raising seedlings, insectiside sheets for gardening, seed strings, raising seedlings sheets, soilless culture sheets, or filters for liquid, air, oil, and milk, foods wrapping materials, commodity wrapping material, cleaning sheets, wet tissues, diapers, masks, sheets, medical garments, and throwaway materials such as raw waste bags. It can also be used as a triangular corner for a sink stand, or a square or rectangular sink stand, or a reverse conical seedling and culture vessel, or a unified seedling and culturing container of these vessels connected around the peripheral sections. However, it is not limited to these uses, and can be used in all the throwaway uses because it is completely decomposed by the organisms in the soil.

DETAILED DESCRIPTION OF THE INVENTION

EXAMPLE 1

Figure 1:
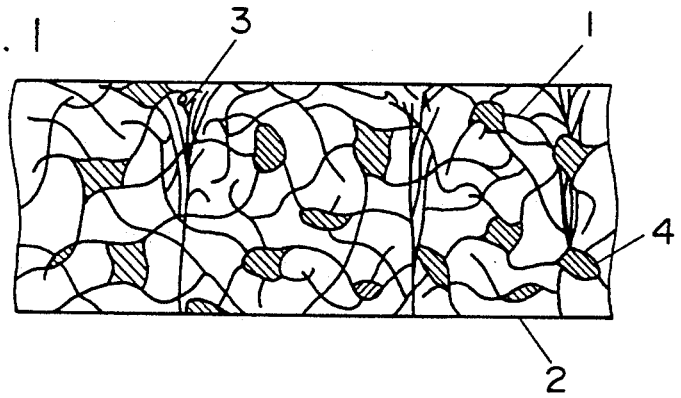
FIG. 1 is a schematic configuration diagram showing an embodiment of the biodegradable nonwoven fabric according to the invention.
Figure 2:
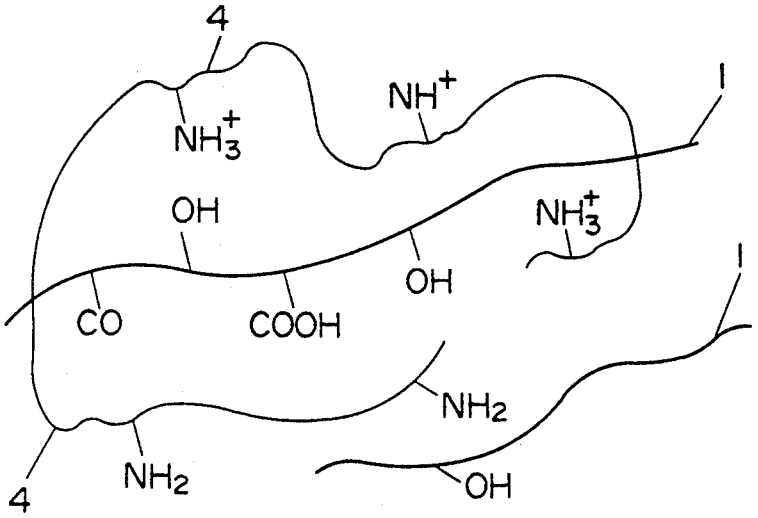
FIG. 2 is a structural diagram before reaction of cellulose and chitosan salt.
Figure 3:
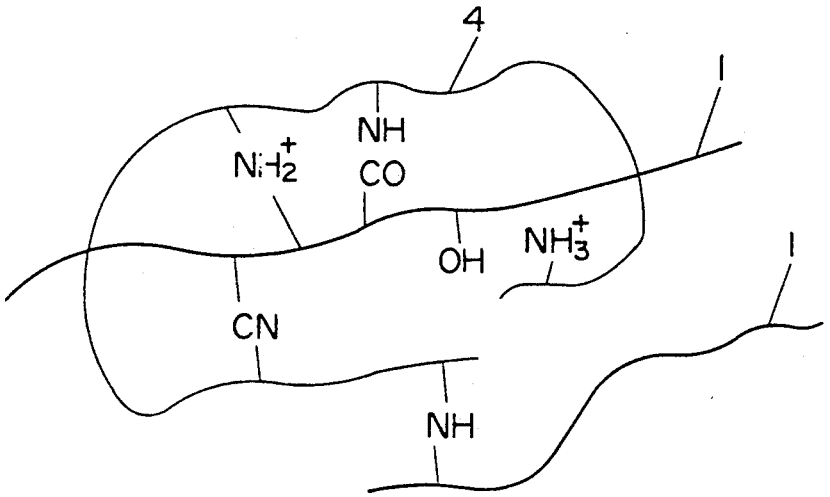
FIG. 3 is a structural diagram after reaction of cellulose and chitosan salt, according to the invention.

As shown in FIG. 1*a* 2*d*×38 mm rayon fiber 1 generally used in the market was used as a cellulose-based fiber, and formed by use of a known card and a webformer such as cross lapper and Rando-webber, into, for example, a cross web 2 of 100 g/m$^2$. This web was given a needle punching 3 to 50 P/cm$^2$ on a needle puncher to form a prebonding needle punched web.

As aqueous 1% chitosan solution was prepared in a ratio of chitosan:lactic acid = 1:1 (by weight), and mixed therein an aqueous 1% suspension of fine cellulose of less than 1 μm in diameter and 200–700 μm in length in a ratio of fine cellulose:Chitosan = 70:30 (by weight) to form an aqueous 1% fine cellulose-chitosan solution.

The above prebonding punched web of 100 g/m$^2$ was processed by dipping in this aqueous solution so that the solid take-up becomes 2 g/m$^2$, and dried in a hot-air drier at 100° C. for 5 min. This gave a biodegradable nonwoven fabric with the parts in cross contact with each other fibers are fixed by the composite 41 of fine cellulose and chitosan to give a biodegradable nonwoven fabric of excellent air permeability and water permeability.

EXAMPLE 2

A biogradable nonwoven fabric with a 4 g/m$^2$ adhesion of fine cellulose-chitosan salt mixture adding 0.1% (4 mg/m$^2$) stearic acid was dipped and dried to give a biodegradable water repellent nonwoven fabric of high strength. Such a nonwoven fabric was suitable as the surface sheet of a diaper.

EXAMPLE 3

Using the same prebonding web as Example 1, a biodegradable nonwoven fabric was prepared in the same manner as Example 1, except that the aqueous 1% solution of fine cellulose-chitosan salt with an addition of glycerin as a plasticizer in a ratio of fine cellulose fiber: chitosan:glycerin = 40:40:20 (by weight) was used.

COMPARATIVE EXAMPLE 1

A prebonding punched cross web of the same of 100 g/m$^2$ as in Examples, was dipped in an acrylic ester emulsion so that the solid content becomes 2 g/m$^2$, and dried in a hot air drier at 100° C. for 5 min or 150° C. for 3 min, to form a nonwoven fabric.

COMPARATIVE EXAMPLE 2

After dipping a prebonding needle punched web in an acrylic ester emulsion so that the solid content becomes 40 g/m$^2$, a treatment like Comparative Example 1 was given to obtain nonwoven fabric.

COMPARATIVE EXAMPLE 3

After dipping a prebonding needle punched web in an SBR emulsion so that the solid content becomes 40 g/m$^2$, a treatment like Comparative Example 1 was given.

COMPARATIVE EXAMPLE 4

After processing a prebonding punched web dipped in an 80% saponification degree PVA aqueous solution so that the solid content becomes 20 g/m$^2$, a same treatment as Comparative Example 1 was given.

On the nonwoven fabrics obtained in the above Examples and Comparative Examples, the finish weight ($g/m^2$), dry strength, wet strength (*1), molding properties (*2), and dry/wet strength ratio (*3) were measured and shown in Table 1.

TABLE 1

| Sample | Measuring Item | | | | |
|---|---|---|---|---|---|
| | Weight ($g/m^2$) | Dry strength (kg/5 cm-width) | Wet strength (kg/5 cm-width) | Dry/wet ratio (%) | Molding property |
| Example 3 | 102 | 2.05 | 1.03 | 50.2 | ◎ |
| Example 1 | 102 | 2.10 | 1.16 | 55.2 | ◎ |
| Example 2 | 104 | 3.24 | 1.94 | 59.9 | ◎ |
| Comparative example 1 | 102 | 0.52 | 0.25 | 48.1 | x |
| Comparative example 2 | 140 | 1.96 | 0.78 | 39.8 | ∘ |
| Comparative example 3 | 140 | 1.83 | 0.73 | 39.9 | ∘ |
| Comparative example 4 | 120 | 2.03 | 0.81 | 40.0 | Δ |

*Examples 1-3 and Comparative example 1-4 use a 2d × 38 mm rayon 100% web of fiber weights 100 $g/m^2$, prebonding 100 $P/cm^2$ needle punched.
*1 Wet strength: Measured on the sample immediately after being left to stand in 40° C. warm water for 5 min.
*2 Molding properties: Nonwoven fabric sheets obtained in the above Examples and Comparative examples were inserted into a flower pot type mold and dried with hot air. The molding properties of obtained nonwoven fabric moldings were compared.
◎ Very good ∘ Good Δ Common x Poor
*3 Dry/wet strength ratio: Wet strength/dry strength × 100%

The seven types of nonwoven fabric made by these Examples and Comparative examples were buried in soil (5 cm deep from the ground surface), and three months after the degree of decomposition was observed. The results are shown in Table 2.

TABLE 2

| Sample | Conditions of decompositon |
|---|---|
| Example 3 | Completely decomposed without any trace. |
| Example 1 | Completely decomposed without any trace. |
| Example 2 | Completely decomposed without any trace. |
| Comparative example 1 | Rayon is completely decomposed but acrylic ester resin remains it is. |
| Comparative example 2 | Rayon is completely decomposed but acrylic ester resin remains as it is. |
| Comparative example 3 | Rayon is completely decomposed but the SBR resin remains as it is. |
| Comparative example 4 | Rayon is completely decomposed and PVA resin disappears dissolved. |

As shown in the table, in comparison with the comparative examples formed by use of a general synthetic resin or synthetic rubber binder, the nonwoven fabric according to the invention gives an excellent dry and wet strengths and molding properties, by only heating as a result of using fine cellulose containing chitosan salt as the main binder.

Regarding the biodegradability, the acrylic ester resin and SBR resin remain intact without being decomposed and portions covered completely by such a resin remains without decomposition.

The nonwoven fabric in Comparative Example 4, when used as agricultural seedling culture sheet and container, for civil engineering and building concrete panel, soil stabilizing, and banking use, the nonwaven fabric collapsed in short time because of water solubility of the PVA resin and quite immpossible to attain the object.

EXAMPLE 4

One hundred percent polynosic rayon fiber 2d×38 mm were formed into random web of 80 $g/m^2$ by a web former such as Rando-wobber. Then, the web was needle punched into a prebonding fixed web of 100 $P/cm^2$ with partially entangled fibers, by a needle punching machine.

The prebonding fixed web was then impregnated with a solution of the following composition:

| | Blending ratio |
|---|---|
| Chitosan | 2 parts |
| Lactic acid | 1 part |
| Fine cellulose | 11 parts |
| Water | 240 parts |

Figure 4:
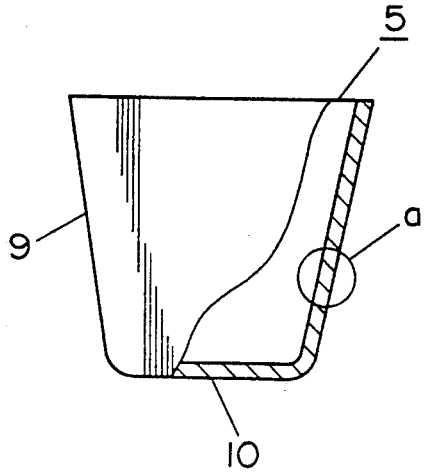
FIG. 4 is a partially broken front view showing a seedling culture pot of another embodiment according to the invention.
Figure 5:
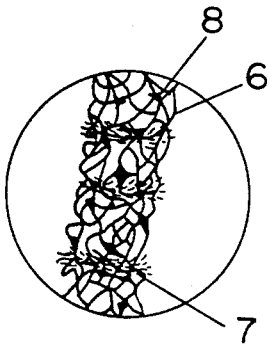
FIG. 5 is an enlarged schematic configuration diagram of part A in FIG. 4.
Figure 6:
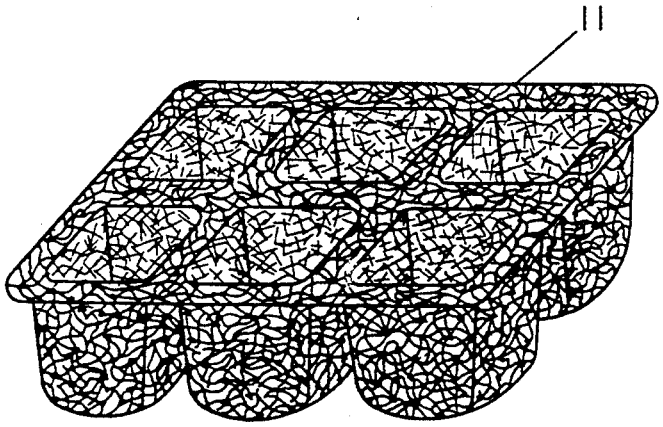
FIG. 6 is a perspective view of multi-connection type seedling culture pots.
Figure 7:
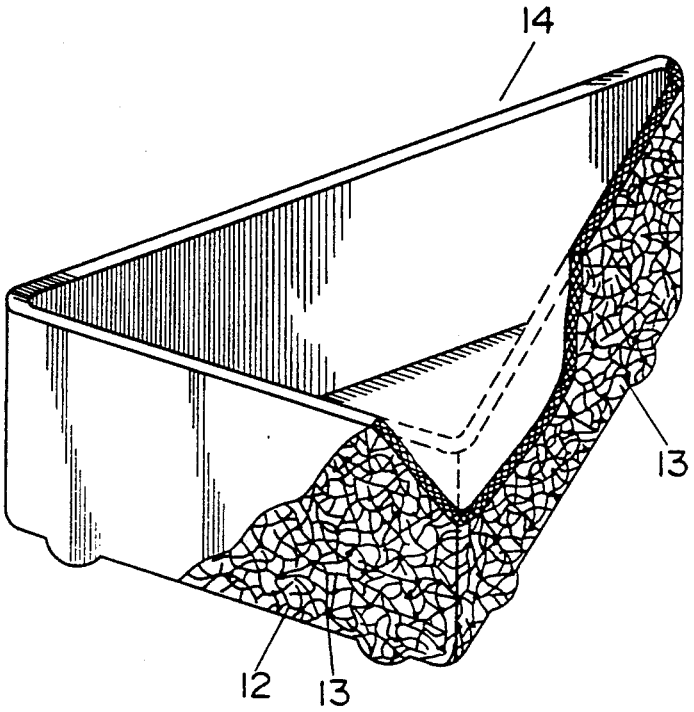
FIG. 7 is a partially broken perspective view showing a waste receiving vessel of another embodiment according to the invention.

With an aqueous fine cellulose-chitosan salt solution applied in an amount of 4% (solid content), based on the quantity of fiber, a seedling culture pot 5 of 4 cm dia. and 4 cm deep as shown in FIG. 4 was molded by hot pressure molding by use of a mold. The thus molded seedling culture pot is composed, as shown in the partially enlarged sectional view of FIG. 5, of porous side walls 9 comprising a fiber web of cellulose based rayon fibers 6 having three dimensional entangling sections 7 in specified intervals with the entangling sections bonded by inter-functional group reaction between fine cellulose and chitosan binder 8 and that between rayon fiber and chitosan functional group, and a porous bottom wall 10.

EXAMPLE 5

A random web of 100 $g/m^2$ was formed viscose rayon fibers 3d×38 mm by a rando-webber machine, a binder of the same composition as in Example 3 was applied in solid content of 4% to the fibers, and the web was hot-pressure molded in wet condition by use of a mold to form seedlings culture pots 11 of multi-connection type.

Each of the pots (1000) pieces obtained above was planted with a garden zinnia and the growing conditions were investigated by the bottom sprinkling method. As a comparison, polyethylene pots on the market were planted with garden zinnias.

Two months thereafter each plant was transplanted by pot to the alley and the growth of the plant and the decomposition of pot thereafter were investigated. The results are shown in Table 3.

TABLE 3

| Sample | Seedling culture conditions | Conditions after permanent planting |
|---|---|---|
| Example 4 | Number of withered pots: 10<br>Seedling height: 5 cm<br>Water absorption properties: good | Pot strength is lost in 1-2 weeks after permanent planting, No rearing obstruction is found. The fiber is decomposed in 1-2 years and no soil contamination is found |
| Example 5 | Number of withered pots: 5<br>Seedling height: 7 cm<br>Water absorption properties: good | Pot strength is lost in 1-2 weeks after permanent planting, No rearing obstruction is found. The fiber is decomposed in 1-2 years and no soil contamination is found |
| *Comparative example | Number of withered pots: 100<br>Seedling height: 3 cm<br>Water absorption and breathability poor. Affinity to water absorbed cloth | When permanent planting, polyethylene pot must be removed. Workability is poor |

TABLE 3-continued

| Sample | Seedling culture conditions | Conditions after permanent planting |
|---|---|---|
| | is poor. | |

*Molded pot
2 × 2 cm
100 pieces: 1 group
Number of seedlings: 1,000 plants (molded pot 10 groups)

As obvious from the above results, the nonwoven fabric pots in Examples 4 and 5 are excellent in drape properties and softness, the fitness to the water absorption mat present in the bottom of a pot is very good. The excellent water absorbing properties and air permeability permits water absorption and ventilation not only through the bottom of the pot but also through the side walls. This decreases the dispersion of seedling height every connected pot and number of withered plants.

Since the fiber and binder are of biodegradable material, it is possible to permanently plant the plant pot and all.

On the other hand, polyethylene pot has rigid feeling, and little air permeability and water suction properties, and ventilation and water suction are effected only through the weep hole provided in the bottom. This increases the dispersion of seedling height and number of withered plants. Also, being not decomposed by the microorganisms in the soil, the pot must be removed when permanently planting, requiring large labor.

EXAMPLE 6

A web of 200 g/m$^2$ in weight was formed from a viscose rayon fiber of 2d×51 mm using a web forming machine such as Rando-webber machine.

The above web was needle punched in the conditions of 100 P/cm$^2$ to form a fiber mat with entangled fibers with each other. Further, an L-ascorbic acid and cellulose containing aqueous chitosan solution was applied to it in a solid content of 5% by weight to the fiber, and hot pressure molding was given to it in wet condition by use of a mold. A porous triangular garbage receiver container 14 for sink stand with apparent density of 0.12 g/cm$^2$ with thickness 1.5 mm was formed fixed by composition between fibers each other in the entangled mat 12 or between the fine cellulose-containing chitosan binder 13.

| Compounding ratio | |
|---|---|
| L ascorbic acid/chitosan | 2 parts |
| Lactic acid | 1 part |
| Fine cellulose | 7 parts |
| Water | 240 parts |

It is also possible to give a germ resistant function to the waste receiving container by spraying an aqueous 5% solution of PVA resin of plymerization degree 1700, saponification degree 98% containing 0.05% chlorohexidine to solid content of 4% and drying.

EXAMPLE 7

Figure 8:
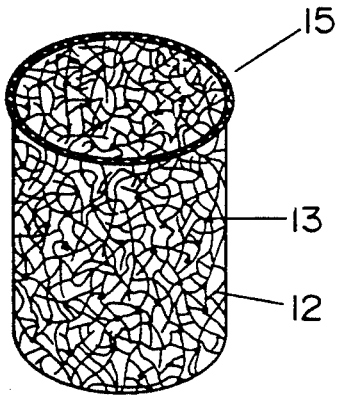
FIG. 8 is a perspective view of a wastebasket for receiving waste at the drainage hole according to the invention.
Figure 9:
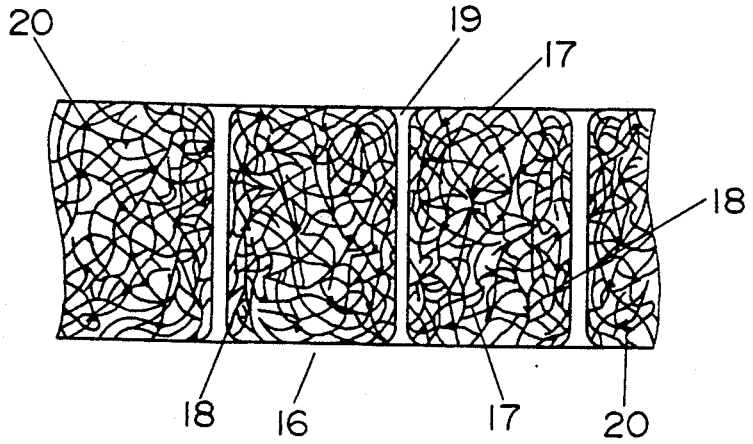
FIG. 9 is a schematic sectional view sowing the construction of a biodegradable nonwoven fabric formed by combined use of a fine cellulose-chitosan binder and physical binding means, according to the invention.
Figure 10:
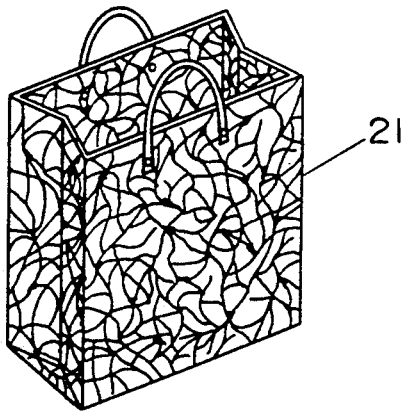
FIG. 10 is a perspective view showing an example of shopping bag formed according to the invention.

To an entangled fiber mat formed of the same fiber in the same fiber weight (g/m$^2$) and in the same mat preparing conditions as Example 6 applied an aqueous chitosan solution of the same formulation in solid content of 5%, and was hot pressure molded in wet conditions by use of a mold. A wastebasket 15 1.5 mm thick, 12 cm in diameter for receiving the waste from the bottom of kitchen drainage port was obtained as shown in FIG. 8. The waste receiving container obtained in the above Example had a porous Example had a porous structure of nonwoven fabric, was excellent in filtering capacity, and draining through the whole container was possible. The internal filtering action is difficult to cause clogging, can catch even smaller raw waste and can mitigate the water pollution factor. By giving a germ resistant function, the kitchen sanitation can be held in good state without production of sliminess and mold, or offensive odor.

When discarding after use, by burying in the soil pouring boiling water, as required, it vanished by decomposition in the natural cycle, not causing secondary pollution.

EXAMPLE 8

Using as the cellulose-based fiber acetate fiber 2d×38 mm generally on the market, a fiber mat of 80 g/m$^2$ was formed by use of a web forming unit comprising a known carding engine and cross lapper.

The fiber mat is then water punched with a known water needling machine of orifice diameter 1 mm to entangle the fibers in the mat each other. As the injection fluid for the water punching, an aqueous fine cellulose-chitosan salt solution, an aqueous lactic acid solution with chitosan dissolved therein to a concentration of 1% and with fine cellulose mixed therein, was used instead of water. Then, the mat was adjusted with a dehydrator or squeezing mangle to a solid content of 2 g/m$^2$, and dried at 100° C. for 5 min to form a biodegradable nonwoven fabric of 82 g/m$^2$.

The biodegradable nonwoven fabric 17 obtained had entangled sections 18 formed of the fiber mat comprising acetate fibers 17 with the fibers forming entangled sections 18 by the water punching in the aqueous chitosan salt solution as an injection fluid, through holes 19 formed by punching, and further having physically fixed and chemically fixed sections with the fibers connected between each other by the composition of the attached fine cellulose-chitosan composite 20.

The thus formed biodegradable nonwoven fabric had excellent antifungal action of chitosan and excellent water absorption properties, and was best suited for food wrapping, particularly, as a freshness keeping material for perishable foods such as meat and fishes.

EXAMPLE 9

A random web was formed from 100% rayon fibers 2d×38 mm through a rando-webber machine, and needle punched through a needle punching machine to 100 P/cm$^2$, to form a fiber sheet prebonding fixed between fibers in the web.

The prebonding fixed fiber sheet was impregnated with the cellulose containing chitosan salt binder used in Example 1 so that the dry adhesion becomes 3 g/m$^2$, and was dried to form a biodegradable nonwoven fabric of 63 g/m$^2$, and cut into required dimensions. After wetting with water, it was hot molded to form a shopping bag 21 shown in FIG.

EXAMPLE 10

A random web of 200 g/m$^2$ was formed from 100% absorbent cotton through a rando-webber machine, and was impregnated with the fine cellulose-chitosan salt binder produced from a 1% chitosan solution containing chitosan and acetic acid a ratio of 1:0.5 by weight and dried, to form a biodegradable nonwoven fabric of 204 g/m$^2$ with the fibers fixed to each other with the above binder attached.

EXAMPLE 11

Figure 11:
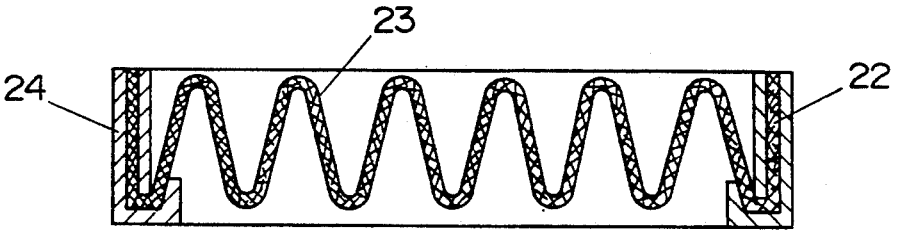
FIG. 11 is a sectional view showing a filter unit of another embodiment of the invention.
Figure 12:
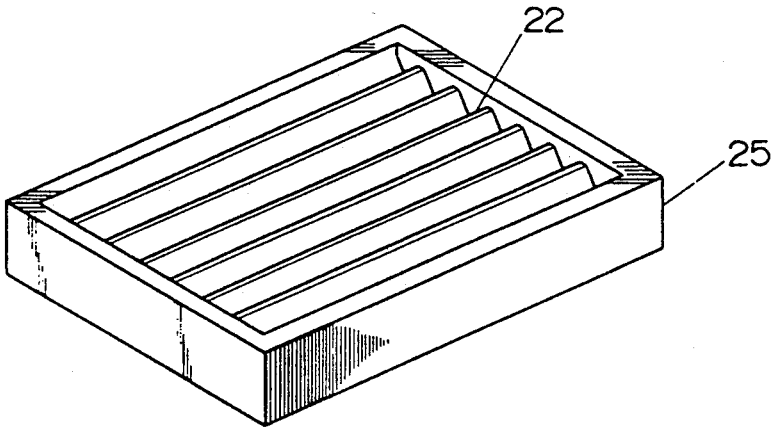
FIG. 12 is a perspective view of a filter unit according to the invention.

A biodegradable nonwoven fabric formed in the same manner as in Example 1 was used as a filter element 22 and cut into specified dimensions. As shown in FIG. 11, the cut-out piece was given a bending process of height 20 mm and pitch of 9 peaks per 10 cm, and mounted in a mold. An aqueous 3% chitosan solution prepared in a formulation of:

| |
|---|
| Chitosan salt:fine cellulose:acetic acid = 70:30:35 (by weight) |

was poured into the mold and after molding at 100° C. for 530 min and drying, the mold was removed. A housing 25 comprising fine cellulose-chitosan salt around the filter element as shown in FIG. 12 was formed to make a biodegradable filter unit.

This nonwoven fabric was suitable to the throwaway use for filtering liquid such as oil, milk, and resin solution.

According to the invention, by the composite produced by chemical bonding produced when heating, between the functional groups of chitosan salt and cellulose fiber constituting the fine cellulose and nonwoven fabric, the alkali fixing treatment is dissolved, and with a small quantity of the binding agent a biodegradable nonwoven fabric is produced which is excellent in dry strength and wet strength. Because of its moldability, it can be processed into containers or shapes for various use. The biodegradability dissolves the pollution when disposing it.

When used in raising seedlings and pot culture, exerts excellent water absorbing properties and air permeability, accelerates the growth. Since completely decomposed by the microorganisms in the soil, the growth of the plants is not interfered with.

When used as wrapping material and agricultural and gardening sheets, it is naturally decomposed in the soil without requiring burning unlike the plastics products so far. The material resulting from the degradation is harmless and can be used as an organic fertilizer.

When used as raising seedlings sheet, has good maintenance of seedlings. As the seeds germinate and grow, it is gradually decomposed by the microorganisms in the soil, and in growing period, the nonwoven fabric completely vanishes by decomposition not requiring means of recovery and burning. Thus, it has excellent workability and dissolves the pollution problems.

What is claimed is:

1. A biodegradable nonwoven fabric comprising a fiber web composed of at least one type of cellulose-based fiber selected from the group consisting of natural fibers, regenerated fibers, acetate fibers and mixtures thereof, said fiber web bonded with a binder of a fine cellulose-chitosan composition in amounts sufficient to impart biodegradability thereto, said fine cellulose being a beaten pulp of 20–1000 μm in length and less than 1 μm in thickness.

2. A biodegradable nonwoven fabric comprising a mat of cellulose-based fibers entangled by needle punching or water-jet punching with a fine cellulose-chitosan composition applied on the surface of each fiber, said fine cellulose being a beaten pulp of 20–1000 μm in length and less than 1 μm in thickness, said cellulose-based fibers selected from the group consisting of natural fibers, regenerated fibers, acetate fibers and mixtures thereof.

3. A biodegradable nonwoven fabric as claimed in 1 or 2, wherein said natural fiber is cotton or flax, and said regenerated fiber is selected from the group consisting of viscose rayon, cuprammonium rayon, modified cross-sectional rayon, and porous rayon.

4. A biodegradable nonwoven fabric as claimed in 1 or 2, wherein said biodegradable nonwoven fabric is bonded with a fine cellulose-chitosan composition containing a water repellency modifier comprising a higher fatty acid.

5. A biodegradable nonwoven fabric as claimed in 1 or 2, wherein said nonwoven fabric is bonded with a fine cellulose-chitosan composition containing glycerine as a plasticizer.

6. A biodegradable nonwoven fabric as claimed in 1 or 2, wherein said nonwoven fabric is bonded with a fine cellulose-chitosan composition containing a higher fatty acid as a water repellency modifier and glycerine as a plasticizer.

7. A biodegradable nonwoven fabric as claimed in 1 or 2, wherein the proportion of the fine cellulose-chitosan composition is 0.5–10 parts by weight based on 100 parts by weight of the fiber.

8. A biodegradable nonwoven fabric as claimed in 1 or 2, wherein the mixing ratio of fine cellulose to the chitosan is 2:8 to 4:5.

9. A biodegradable nonwoven fabric according to claim 1 or 2 wherein said cellulose-based fiber is a natural fiber selected from the group consisting of cotton and flax.

10. A filter unit made of the biodegradable nonwoven fabric as claimed in 1 or 2.

11. A biodegradable vessel comprising the biodegradable nonwoven fabric according to claim 1 or 2, heated and molded into a required shape.

* * * * *